US006487383B2

(12) United States Patent
Buchanan et al.

(10) Patent No.: US 6,487,383 B2
(45) Date of Patent: Nov. 26, 2002

(54) DYNAMIC END-SEAL FOR TONER DEVELOPMENT UNIT

(75) Inventors: John Andrew Buchanan; Jarrett Clark Gayne; Jason Paul Hale; Benjamin Keith Newman; Tom E Stickler, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/833,888

(22) Filed: Apr. 12, 2001

(65) Prior Publication Data

US 2002/0150402 A1 Oct. 17, 2002

(51) Int. Cl.[7] ..... G03G 15/08
(52) U.S. Cl. ..... 399/103; 399/105
(58) Field of Search ..... 399/102, 103, 399/105, 111

(56) References Cited

U.S. PATENT DOCUMENTS

| | | | | |
|---|---|---|---|---|
| 3,809,012 A | * | 5/1974 | Delvecchio | 399/102 |
| 3,985,436 A | | 10/1976 | Tanaka et al. | |
| 4,218,131 A | | 8/1980 | Ito et al. | |
| 4,400,082 A | | 8/1983 | Kiba | |
| 4,498,760 A | | 2/1985 | Sugiyama | |
| 4,500,195 A | | 2/1985 | Hosono | |
| 4,540,268 A | | 9/1985 | Toyono et al. | |
| 4,564,283 A | | 1/1986 | Fox | |
| 4,616,919 A | | 10/1986 | Adley et al. | |
| 4,627,701 A | | 12/1986 | Onoda et al. | |
| 4,681,426 A | | 7/1987 | Bean et al. | |
| 4,779,119 A | | 10/1988 | Kaieda | |
| 4,791,454 A | | 12/1988 | Takahashi et al. | |
| 4,802,928 A | | 2/1989 | Dunlap | |
| 4,819,030 A | | 4/1989 | Shibano | |
| 4,862,209 A | | 8/1989 | Sakamoto et al. | |
| 4,870,449 A | | 9/1989 | Brown | |
| 4,893,151 A | | 1/1990 | Yamazaki | |
| 4,905,047 A | | 2/1990 | Ariyama | |
| 4,937,632 A | | 6/1990 | Kamidaira | |
| 4,947,216 A | | 8/1990 | Surti | |
| 5,021,830 A | | 6/1991 | Koiso | |
| 5,029,316 A | | 7/1991 | Koiso | |
| 5,202,729 A | | 4/1993 | Miyamoto et al. | |
| RE34,384 E | | 9/1993 | Ishiguro et al. | |
| 5,321,473 A | | 6/1994 | Azami | |
| 5,369,477 A | | 11/1994 | Foote et al. | |
| 5,404,216 A | | 4/1995 | Numagami et al. | |
| 5,455,665 A | | 10/1995 | Baba et al. | |
| 5,475,467 A | | 12/1995 | Watanabe et al. | |
| 5,488,462 A | | 1/1996 | Ishikawa et al. | |
| 5,502,547 A | | 3/1996 | Shirai | |
| 5,550,617 A | | 8/1996 | Odagawa et al. | |
| 5,585,895 A | | 12/1996 | Yashiro et al. | |
| 5,655,178 A | | 8/1997 | Ishikawa et al. | |
| 5,697,021 A | | 12/1997 | Watanabe et al. | |

(List continued on next page.)

*Primary Examiner*—Hoang Ngo
(74) *Attorney, Agent, or Firm*—John A. Brady

(57) ABSTRACT

An article used to seal the interface between the developer roll, doctor blade and developer housing in a laser printer toner cartridge is described. The sealing member described in the present application performs static sealing between the components while the cartridge is idle and performs dynamic sealing while the toner cartridge is used for printing, keeping the sealing surfaces free from toner by actively pushing the toner back into the developer sump. The seal has a rotary seal portion which seals between the frame of the cartridge and the developer roll, and a blade seal portion which seals between the frame of the cartridge and the doctor blade. The rotary seal portion is biased toward the surface of the developer roll and incorporates, on its face adjacent to the developer roll, ridges which act to push the toner away from the edge of the developer roll in use. The blade seal portion is biased toward the doctor blade.

19 Claims, 7 Drawing Sheets

U.S. PATENT DOCUMENTS 5,697,022 A 12/1997 Matsuda et al.
5,701,558 A 12/1997 Kojima
5,758,230 A 5/1998 Nakaue et al.
5,774,765 A 6/1998 Hirota et al.
5,778,282 A 7/1998 Nagashima
5,805,958 A 9/1998 Fisk
5,805,965 A 9/1998 Tsuda et al.
5,809,374 A 9/1998 Tsuda et al.
5,870,651 A 2/1999 Shimanda
5,895,144 A 4/1999 Nishimura
5,895,151 A 4/1999 Kinoshita et al.
5,987,277 A 11/1999 Okabe
5,995,774 A 11/1999 Applegate et al. ..... 399/27
6,009,285 A 12/1999 Barry et al. ..... 399/12
6,035,158 A 3/2000 Asakura et al.
6,049,689 A * 4/2000 Ishii et al. ..... 399/284
6,094,550 A 7/2000 Kido et al.
6,115,565 A 9/2000 Noda
6,178,301 B1 1/2001 Kojima et al.
6,181,897 B1 1/2001 Kawai
6,185,392 B1 2/2001 Hoshi
6,195,515 B1 2/2001 Fujita et al.
6,205,304 B1 3/2001 Kawaguchi
6,212,343 B1 4/2001 Hosokawa et al.

* cited by examiner

DYNAMIC END-SEAL FOR TONER DEVELOPMENT UNIT

TECHNICAL FIELD

The present invention relates to seals used in the electrophotographic printing process, particularly in laser printer toner cartridges. The seals prevent the leakage of materials, such as toner, from the cartridges.

BACKGROUND OF THE INVENTION

In the electrophotographic printing process, an image-forming apparatus, such as a printer, performs selective exposures onto a uniformly charged image carrier to form a latent image. The latent image is made visible by toner, and the toner image is transferred to a recording medium so that the image may be rendered permanent. In such an apparatus, additional toner must be supplied each time it is used up. Not only is this operation for supplying toner inconvenient, but the operator's hands or clothing may become dirty if they come in contact with the toner. Also, the presence of the toner makes it necessary to periodically perform maintenance on each member of the apparatus. The result is leakage and spillage of toner that is best avoided in the electrophotographic printing apparatus.

FIG. 1 illustrates a conventional process cartridge in which supplying of toner and replacement of parts of an image carrier whose service life is finished are made possible when a user loads the cartridge into the main body of the printing apparatus. Maintenance is made easier since an image carrier (50), a charger (51), a developing unit (developer roll) (52), a cleaning unit (53), and the like, are formed integrally into the cartridge. Cartridges of this type are disclosed, for example, in U.S. Pat. Nos. 3,985,436; 4,500,195; 4,540,268; 4,627,701; 5,995,774; and 6,009,285; all of which are incorporated herein by reference.

In such a process cartridge, the developing unit is provided with a sealing member (55) so that the toner will not leak out from a gap formed between the developer roll (52) and a development frame member (54). The cleaning unit (53) has a sealing member (56) provided in the end portion of the image carrier (50) so that waste toner will not leak out from the gap formed between the end portion of the image carrier (50) and the waste toner well **(53*a*)**.

Sealing between the developer roll (52), the doctor blade (57), and the developer housing (frame) (54) is difficult because the developer roll is a rotating cylinder immersed in toner for a portion of its revolution and exposed external to the developer unit for the other portion of the cycle. The doctor blade moves in a direction perpendicular to the tangential surface velocity of the developer roller making sealing difficult. A seal must also be made between the doctor blade seal and the lower developer roll seal that extends the length of the developer housing to the other end seal.

One type of the above-mentioned sealing member is formed from foam rubber, felt or the like so that it can be applied onto a container. Another type is formed from a material such as plastic, as a lip portion which slideably contacts process means such as the developer sleeve (52), the frame member (54) or the like so that the seal can be installed into the frame member. With the former sealing member, it is time-consuming to apply the sealing member and automation of attachment is difficult. The latter sealing member has the advantage that attachment is easy. However, the dimensions of the portion where the sealing member comes into close contact with the frame member varies, causing the problem, for example, of the toner leaking from the gap.

A commonly used seal on laser printer toner cartridges incorporates a dynamic seal design consisting of two lip seals in contact with the developer roll and doctor blade that are angled relative to the developer roll surface velocity direction in order to actively push (snowplow) toner back into the developer sump. This seal design requires an internal pocket in the developer housing for retention and support. This pocket can be created in cartridges by attachment of external pieces, such as end caps. These external pieces add additional costs to the toner cartridge and add additional part interfaces that can allow toner leakage if not sealed by an additional means. The additional means of sealing these end cap interfaces is frequently accomplished by the use of a putty substance and/or a wax substance. Application of these substances onto the cartridge is difficult, costly, and they are prone to contaminate other critical areas of the cartridge when mis-installed. This type of seal is described in IBM Technical Disclosure Bulletin, Vol. 33, No. 38, pg. 29 (1990).

U.S. Pat. No. 5,697,021, Watanabe, et al., issued Dec. 9, 1997, describes a sealing means for a toner cartridge formed from a soft plastic material. The U-shaped seal mounts on the end of the cartridge (see FIG. 11 of the Watanabe, et al. patent) and may include an extended lip which scrapes toner off the doctor blade and back into the toner sump (see FIG. 6 of the Watanabe, et al. patent). These structures do not utilize ridges on the inside face of the seal to guide toner back into the cartridge. See also, U.S. Pat. No. 5,475,467, Watanabe, et al., issued Dec. 12, 1995.

U.S. Pat. No. 5,550,617, Odagawa, et al., issued Aug. 27, 1996, describes a process cartridge for an electrophotographic printer, the elements of which are made from a synthetic resin, making recycling of the cartridge components easy and effective. End-seals made from the synthetic resin are disclosed; they may be integral with the blade members or the blade supports. Again, there is no discussion of placing ridges on the inside face of the seal to guide toner back into the cartridge (see FIGS. 8–11 of the Odagawa, et al. patent).

U.S. Pat. No. 5,502,547, Shirai, issued Mar. 26, 1996, describes sealing members for use in a toner cartridge which comprise a resin face plate having a tongue and groove means on one face for attaching to the printer, and a foam portion on the other face to form the seal (see FIG. 8 of the Shirai patent). The key to this patent is that the seals can be recycled. Again, there is no discussion of using ridges on the interior face of the seal.

SUMMARY OF THE INVENTION

The present invention relates to a sealing member for an image-forming apparatus including a frame member, a rotary member and a blade member, said sealing member comprising:

- a rotary seal portion for sealing a space formed between the frame member and the rotary member, said rotary seal portion incorporating ridges set at an angle across its face adjacent to the surface of said rotary member;
- a blade seal portion for sealing a space formed between the frame member and the blade member; and
- a means for biasing said sealing member toward the surface of said rotary member and the blade member.

The seal member is typically made from a flexible, low modulus material, such as urethane or artificial rubber. It is generally used to prevent the leakage of toner from an electrophotographic process cartridge; in that instance, the rotary member is generally a developer roll and the blade member is a doctor blade. The means for biasing the seal can be, for example, a cantilever beam, cantilever springs or a foam strip.

The present invention also encompasses a process cartridge detachably mountable to an image-forming apparatus, said process cartridge comprising:

a frame member;

a rotary member mounted on said frame member, said rotary member constituting process means;

a blade member elastically contacting said rotary member; and a sealing member comprising a rotary seal portion for sealing a space formed between the frame member and the rotary member, said rotary seal portion incorporating ridges set at an angle across its face adjacent to the surface of said rotary member;

a blade seal portion for sealing a space formed between the frame member and the blade member; and a means for biasing said sealing member toward the surface of rotary member and the blade member.

DETAILED DESCRIPTION OF THE INVENTION

Figure 1:
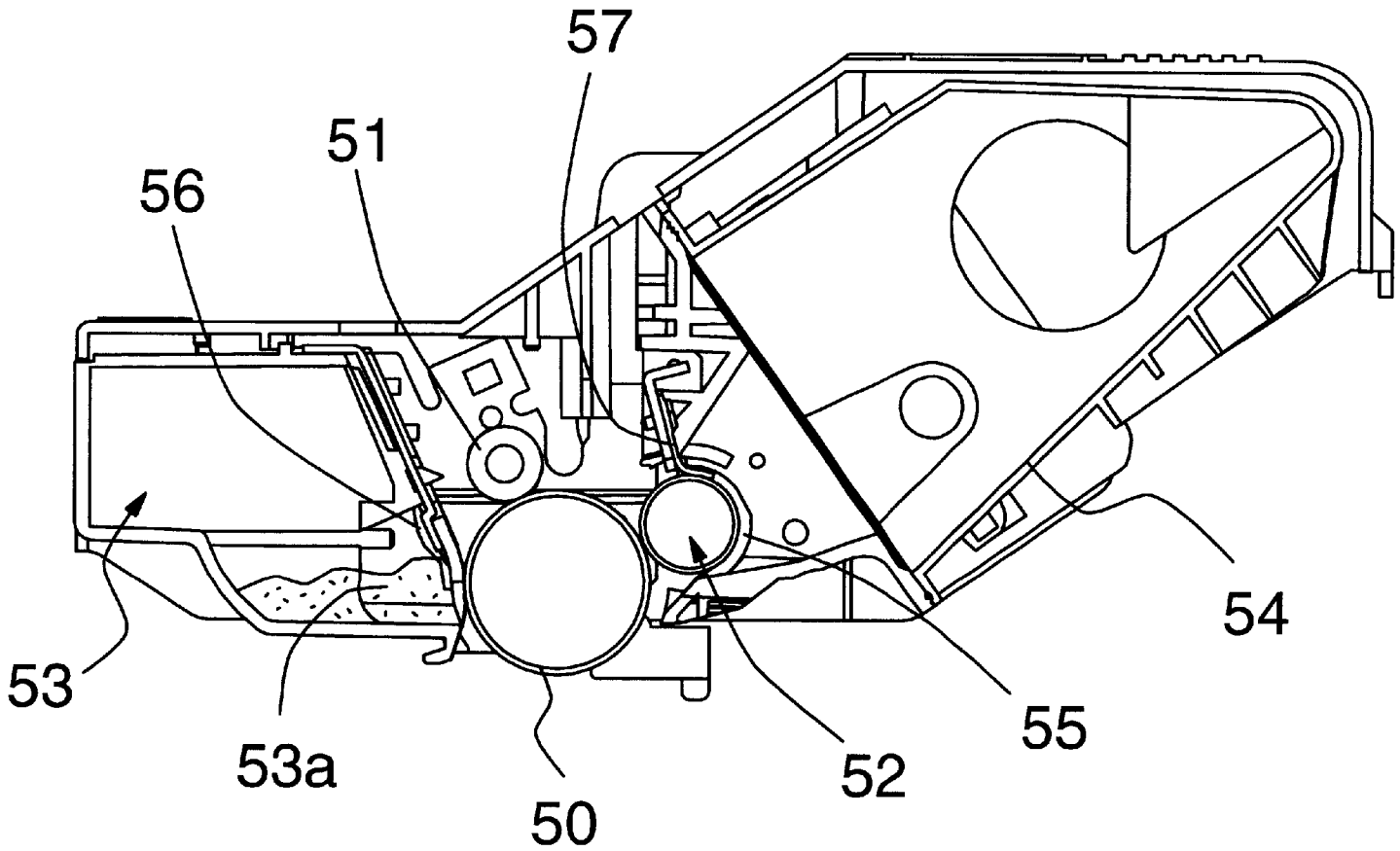
FIG. 1 is an illustration of a prior art toner cartridge.
Figure 2:
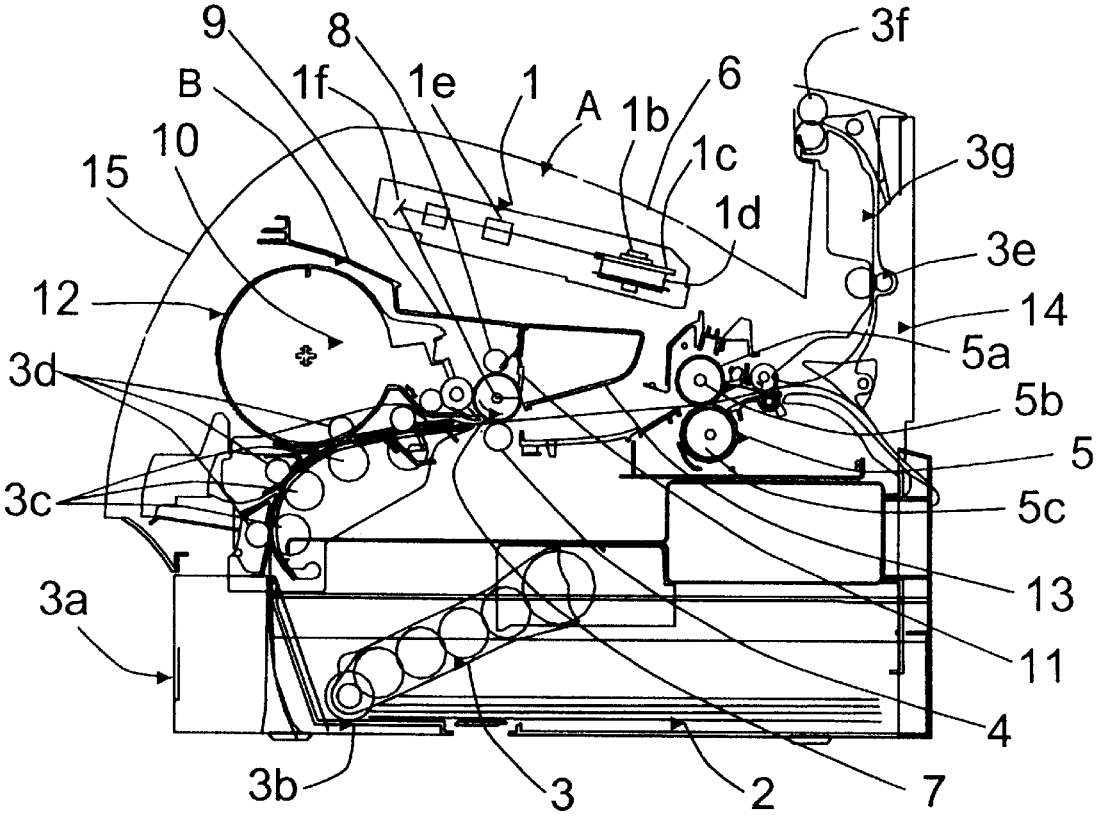
FIG. 2 is a sectional view of an image-forming apparatus which incorporates the present invention.
Figure 3:
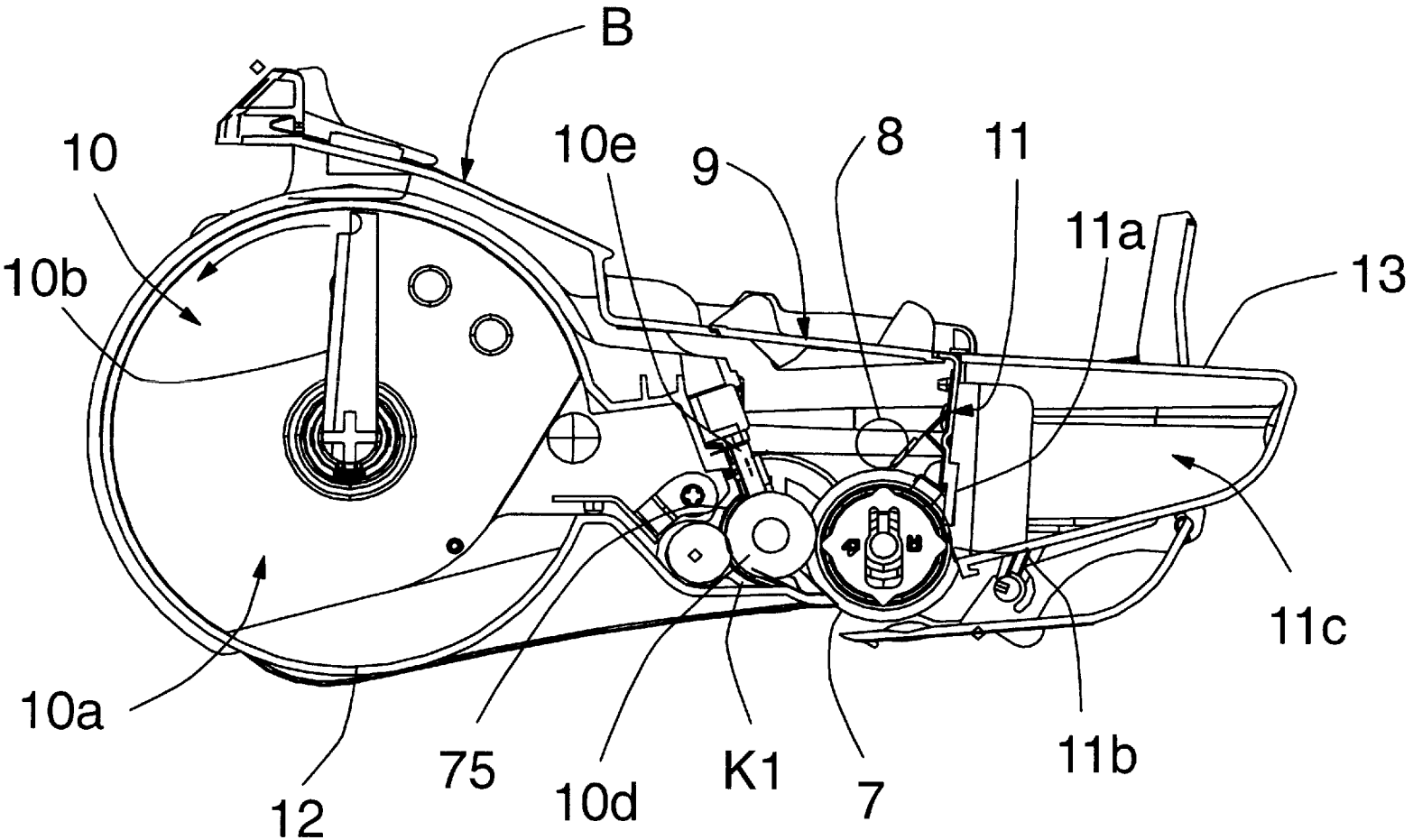
FIG. 3 is a sectional view of the process (toner) cartridge which may be loaded into the image-forming apparatus.

A schematic construction of a image-forming electrophotographic apparatus having a process cartridge installed therein and which utilizes the seal of the present invention is described herein. FIG. 2 is a sectional view of an embodiment of an image-forming apparatus of the present invention, such as a laser printer. FIG. 3 is a sectional view of a process cartridge utilized in the apparatus of FIG. 2.

As shown in FIG. 2, the image-forming apparatus (A) projects a light image based on image information from an optical means (1) so that a developing agent (referred to as "toner") image is formed on a photosensitive drum (7) which is an image carrier. Then, a recording medium (2) is fed by feeding means (3) in synchronization with the formation of a toner image, and the toner image formed on the photosensitive drum (7) in the image-forming section, which is integrally included within a process cartridge (B), is transferred to the recording medium (2) by transfer means (4). The recording medium (2) then is transferred to fixing means (5) where the transferred toner image is fixed onto the recording medium (2), which is then ejected onto an ejection tray (6).

As shown in FIG. 3, the process cartridge (B), which constitutes the image-forming section, makes a photosensitive drum (7) rotate to uniformly charge the surface thereof by charging means (8) and exposes a light image from the optical means onto the photosensitive drum (7) via an exposure section (9) to form a latent image on the photosensitive drum (7). A toner image corresponding to the latent image is formed by developing means (10), thus making the image visible. After the toner image is transferred to the recording medium (2) by the transfer means (4), toner remaining on the photosensitive drum (7) is removed by cleaning means (11). These elements, including the photosensitive drum (7), are housed inside a toner development frame member (12) and a cleaning frame member (13), which together constitute a housing, so that they are formed into a cartridge. Each part of the process cartridge (B) is provided with a sealing member for preventing the toner from leaking.

The construction of each part of the image-forming electrophotographic apparatus (A) will be explained in the following order: optical means, feeding means, transfer means, fixing means, and cartridge mounting means.

The optical means (1) projects a light image onto the photosensitive drum (7) by projecting light on the basis of image information read from an external apparatus or the like. As shown in FIG. 2, a laser diode (1*b*), a polygon mirror (1*c*), a scanner motor (1*d*), and an image-forming lens (1*e*) are housed inside an optical unit (1*a*) of the main body (14) of the apparatus. When, for example, an image signal is supplied from an external apparatus such as a computer or word processor, the laser diode (1*b*) emits light in response to the image signal, and projects the light onto the polygon mirror (1*c*) as image light. Polygon mirror (1*c*) is rotated at high speed by the scanner motor (1*d*). The image light reflected by the polygon mirror (1*c*) is projected onto the photosensitive drum (7) via the image-forming lens (1*e*) and reflecting mirror (1*f*). The surface of the photosensitive drum (7) is thus selectively exposed to form a latent image corresponding to the image information.

The feeding means (3) for feeding the recording medium (2) (e.g., recording paper, OHP sheet, cloth, or thin plate) comprises the following components. A loading portion of a cassette (3*a*) is provided in the inner bottom portion of the main body (14) of the apparatus. When an image formation start signal is input, the recording media (2) within the cassette (3*a*) are fed one-by-one from the top of the stack by a pickup roller (3*b*), feeding rollers (3*c*) and follower rollers (3*d*) pressed against the feeding roller (3*c*).

The sheet of recording medium (2) is fed to the nip portion between the photosensitive drum (7) and the transfer means (4) in synchronization with the performing of the image-formation operation described above; the image is transferred to the recording medium. The recording medium (2) onto which a developed image has been transferred is fed to the fixing means (5) and then ejected onto the ejection tray (6) by a pair of intermediate ejection rollers (3*e*) and a pair of ejection rollers (3*f*). A pair of guide members (3*g*) for guiding the feeding of the recording medium (2) is provided between each of the above-mentioned pairs of rollers.

The transfer means (4) transfers the developed latent image or toner image formed on the photosensitive drum (7) in the image-forming section onto the recording medium (2).

The transfer means (4) in this embodiment consists of the transfer roller (4) as shown in FIG. 2. That is, the recording medium (2) is pressed by the transfer roller (4) against the photosensitive drum (7) of the loaded process cartridge (B). A voltage having a polarity opposite that of the latent image formed on the photosensitive drum (7) is applied to the transfer roller (4) so that the toner on the photosensitive drum (7) is transferred to the recording medium (2).

The fixing means (5) fixes the toner image transferred to the recording medium (2) by applying heat and pressure to the recording medium (2) carrying the toner image. As shown in FIG. 2, the fixing means (5) comprises a driving rotating roller (5*a*) having a heater (5*b*) therein, and a fixing (pressure) roller (5*c*), rotating in a driven manner in pressed contact with the drive roller (5*a*). More specifically, when the recording medium (2) to which the toner image has been transferred moves between drive roller (5*a*) and fixing roller (5*c*), heat is applied by the heater located in the driving rotating roller (5*a*) and pressure is applied to the recording medium by the fixing roller (5*c*), thereby causing the toner (which comprises a colorant and a thermoplastic component) on the recording medium (2) to melt and become fixed to the recording medium (2).

A process cartridge loading means by which the process cartridge (B) is loaded into the image forming apparatus is disposed within that apparatus (A). Loading and unloading of the process cartridge (B) to and from the main body (14) of the apparatus is performed by opening an open/close cover (15). Open/Close cover (15) may be provided with a conventional hinge (not shown) so that it can be opened or closed, and is mounted in the upper portion of the main body (14) of the apparatus. Opening the open/close cover (15) reveals a cartridge loading space provided inside the main body (14) of the apparatus, including conventional left and right guide members (not shown) mounted on the left and right inner-wall surfaces of the main body (14). Each of these guide members is provided with a guide for inserting the process cartridge (B). The process cartridge (B) is inserted into and along the guides, and by closing the open/close cover (15), the process cartridge (B) is loaded into the image-forming apparatus (A).

The components of the process cartridge (B) will now be described.

The process cartridge (B) comprises an image carrier and at least one process means. The process means includes charging means for charging the surface of the image carrier, developing means for forming a toner image on the image carrier, cleaning means for cleaning the toner remaining on the surface of the image carrier, and the like. In the process cartridge (B) of the present invention. as shown in FIG. 3, the charging means (8), the exposure section (9), the developing means (10), and the cleaning means (11) are arranged around a photosensitive drum (7), which is an image carrier. These elements are covered with a frame member formed of the toner development frame member (12) and the cleaning frame member (13) so that they are formed into one unit, thus making it possible to load and unload the unit into and out of the main body (14) of the apparatus. The process cartridge (B) comprises the following elements: the photosensitive drum (7), the charging means (8), the exposure section (9), the developing means (10) and the cleaning means (11).

The photosensitive drum (7) generally has an organic photosensitive layer coated onto the outer peripheral surface of a cylindrical drum base formed from aluminum. The photosensitive drum (7) is rotatably mounted on a frame member of the cartridge and the driving force of a drive motor disposed in the main body (14) of the apparatus is transmitted to a drum cap (not shown). As a result, the photosensitive drum (7) is caused to rotate in the direction of the arrow in FIG. 2 in accordance with the performance of an image-forming operation.

The charging means (8) is used to uniformly charge the surface of the photosensitive drum (7). In the embodiment shown, a so-called contact charging method in which the charging means (8) is mounted on frame member (14) is used.

The charging means (8) is brought into contact with the photosensitive drum (7) so that the charging means (8) contacts the photosensitive drum (7) during the image formation. A DC voltage is applied to the charging means (8), and the surface of the photosensitive drum (7) is uniformly charged.

An exposure section (9) exposes a light image projected from the optical means onto the surface of the photosensitive drum (7) uniformly charged by the charging roller (8) so that a latent image is formed on the surface of the photosensitive drum (7). An opening (9) for guiding the light image onto the top surface of the photosensitive drum (7) is provided to form the exposure section.

As shown in FIG. 3, the developing means includes a toner well (10*a*) or housing toner, and a rotary paddle toner feeding member (10*b*). The toner feeding member (10*b*) is provided within toner well (10*a*) and rotates as shown in FIG. 3, to circulate toner within the toner well (10*a*). A developer roll (10*d*) forms a thin toner layer on the surface thereof as a result of its rotation and is pressed against the photosensitive drum (7).

A development blade (also called a "doctor blade") (10*e*) is disposed adjacent the developer roll (10*d*) to regulate the thickness of the toner layer formed therebetween. The electric charge is imparted to the toner by a biasing voltage on the doctor blade.

As shown in FIG. 3, the cleaning means (11) comprises a cleaning blade (11*a*), positioned in contact with the surface of the photosensitive drum (7) for scraping off the toner remaining on the photosensitive drum (7), a skimming seal (11*b*), positioned below the cleaning blade (11*a*) arranged in weak contact with the surface of the photosensitive drum (7), for retaining up the toner which has been scraped off, and a waste toner well (11*c*) for storing the scraped-off waste toner.

The key aspect of the present invention is the unique seal used to seal the end portions of the developing roller (10*d*), the doctor blade (10*e*) and the developer housing (12) and to keep toner from leaking out at that junction (K1). The seals (75) of the present invention comprise a molded (for example, injection molded or compression molded) part having a ridged surface located adjacent to the developing roller, wherein the ridges run at an angle to the developer roll process direction in order to actively "snowplow" toner off the developer roll surface.

Figure 4:
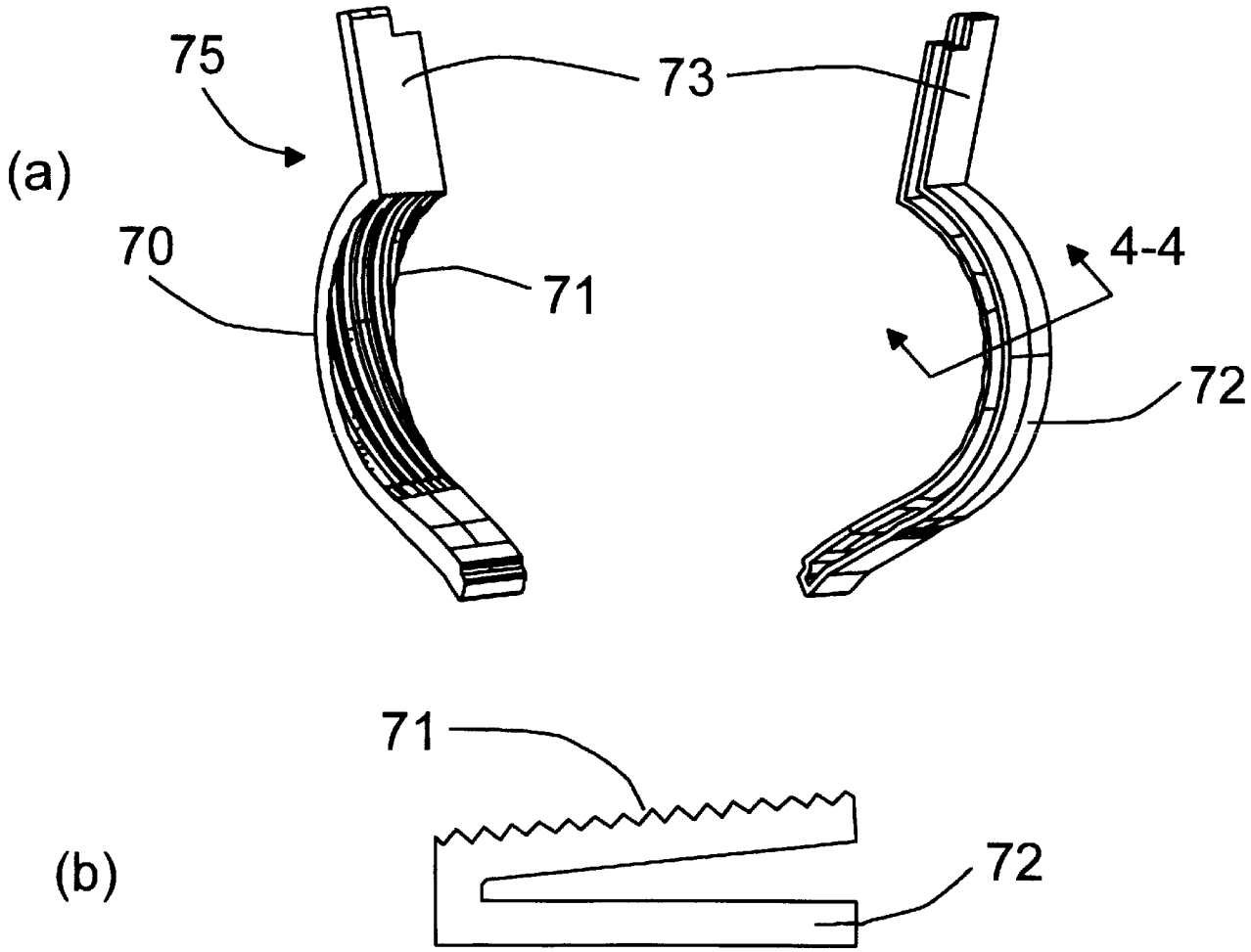
FIG. 4*a* includes front and back isometric views of a seal of the present invention.
FIG. 4*b* is a cross-sectional view of that seal taken at line 4—4.
Figure 5:
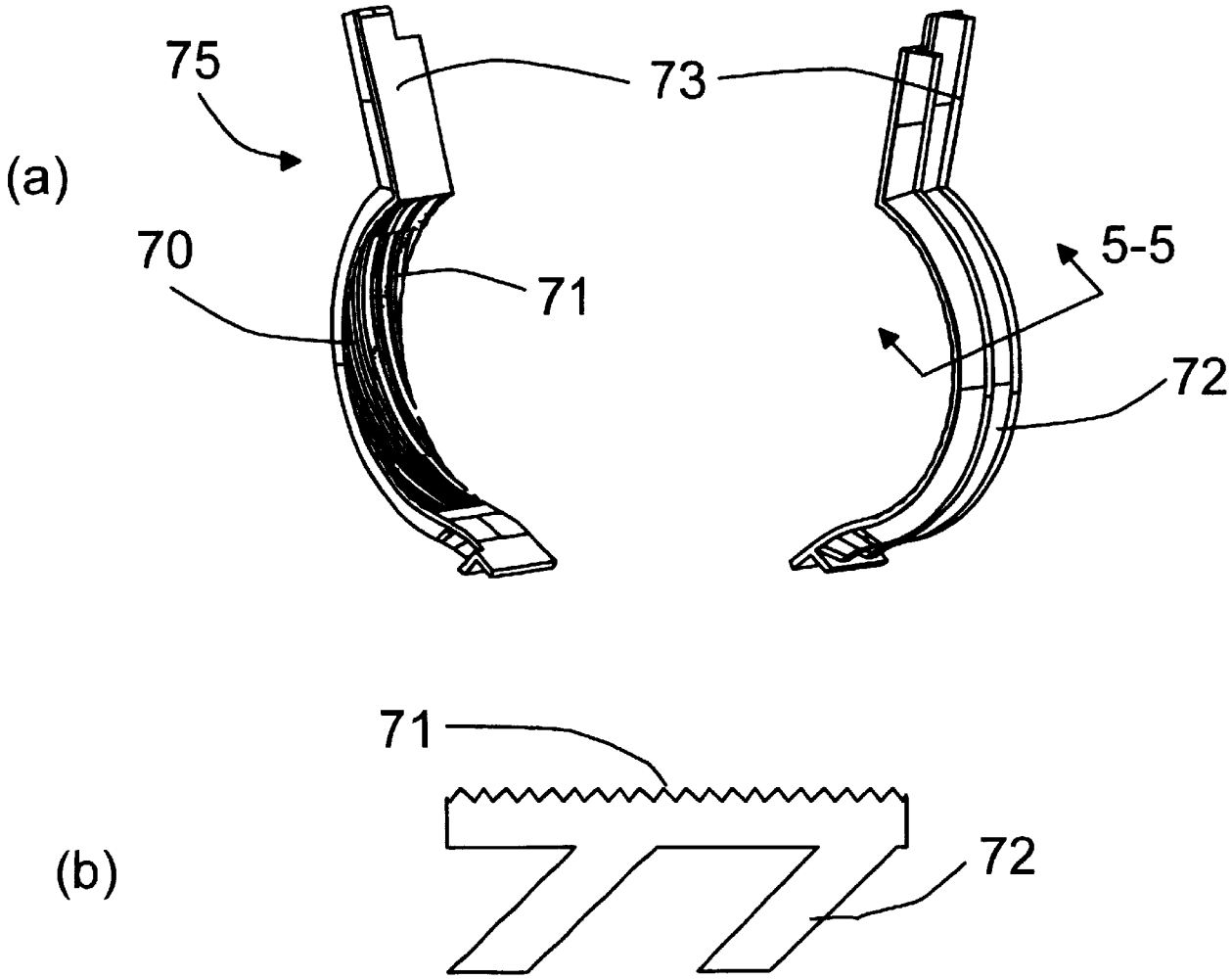
FIG. 5*a* includes front and back isometric views of a second embodiment of the seal of the present invention.
FIG. 5*b* is a cross-sectional view of that seal taken at line 5—5.

Examples of seals of the present invention are shown in FIGS. 4 and 5. The seals comprise a rotary seal portion (70) which seals the space formed between the frame member and the rotary member of the image-forming apparatus. The rotary seal portion has two flat faces. The face of the rotary seal portion which is adjacent to the surface of the rotary member is shown on the left side of FIGS. 4 and 5 and contains the ridges. The ridges run at an angle to the process direction of the rotary member, generally the developer roll (about 1° to about 45° (preferably about 10°), arranged to move toner from the end of the roll toward the middle). By positioning the ridges in this way, they act to push toner away from the edge of the developer roll. The height of the ridges generally is from about 0.05 to about 0.5 mm, preferably about 0.1 mm. The width of the ridges is generally from about 0.01 to about 0.5 mm, preferably about 0.2 mm. The ridges at their base may form an acute angle at their peak, but preferably form a right angle (to the surface of the developer roll) at their peak. In FIGS. 4 and 5, the ridges are denoted as (71). The seal also includes a means for biasing the rotary seal portion toward the surface of the rotary member. This may be accomplished in any way which holds the seal against the rotary member without impairing the rotation of the rotary member. Examples of such biasing means include the use of a cantilever beam, cantilever springs or a foam strip on the face of the rotary seal portion which is facing away from the surface of the rotary member. In FIGS. 4*a* and 5*a*, (72) denotes two different embodiments of the biasing means. The cross-sectional structure of these biasing means (as well as the ridges) is shown in FIGS. 4*b* and 5*b*. The preferred biasing means is a cantilever spring structure.

The seal also includes a blade seal portion (73) for sealing the space formed between the frame member and the blade member (generally the doctor blade) in the image forming apparatus. The blade seal portion of the seal is generally formed such that it is held in place between the blade member and the frame member when positioned in use. The biasing means, discussed above, also biases the blade seal portion (73) against the blade member.

Figure 6:
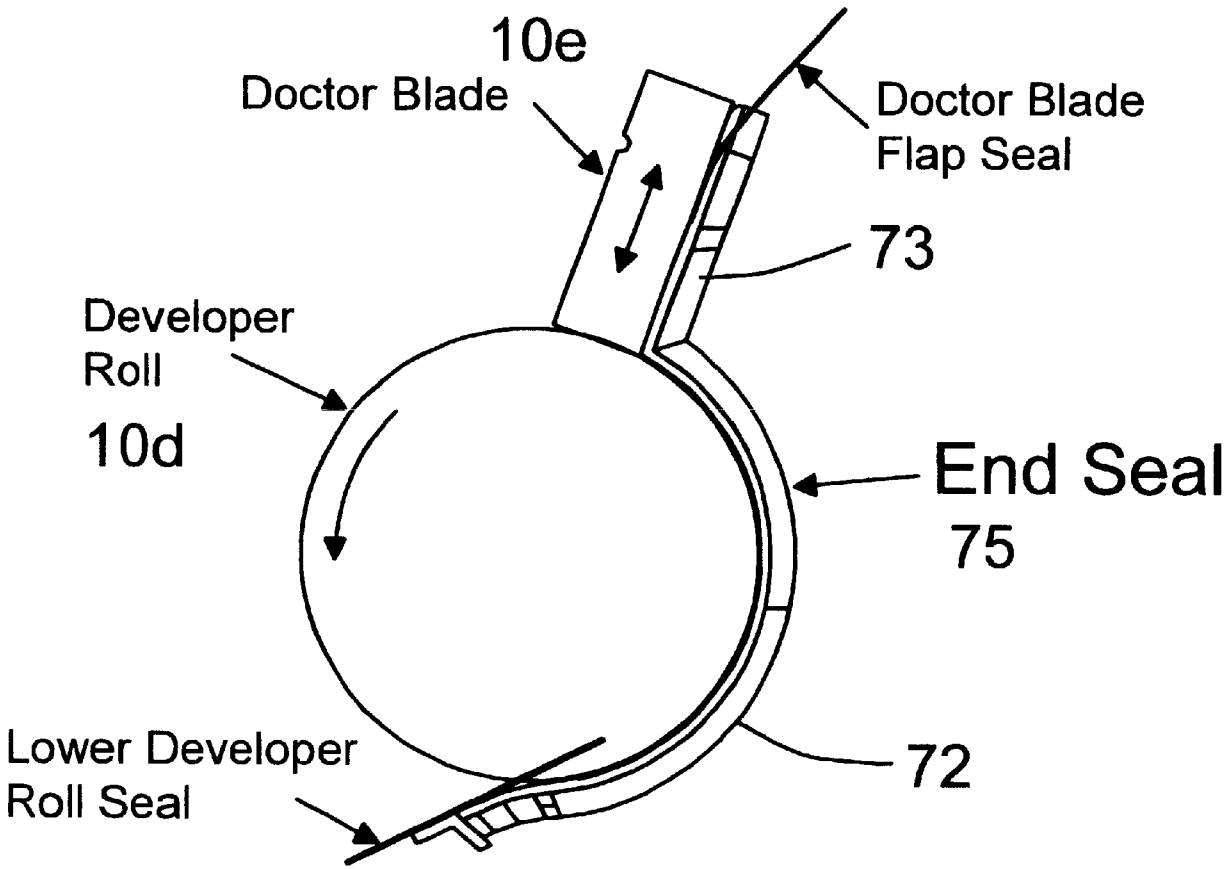
FIG. 6 is a schematic view showing the placement of the seal of the present invention in relation to the developer roll and doctor blade in a process (toner) cartridge.
Figure 7:
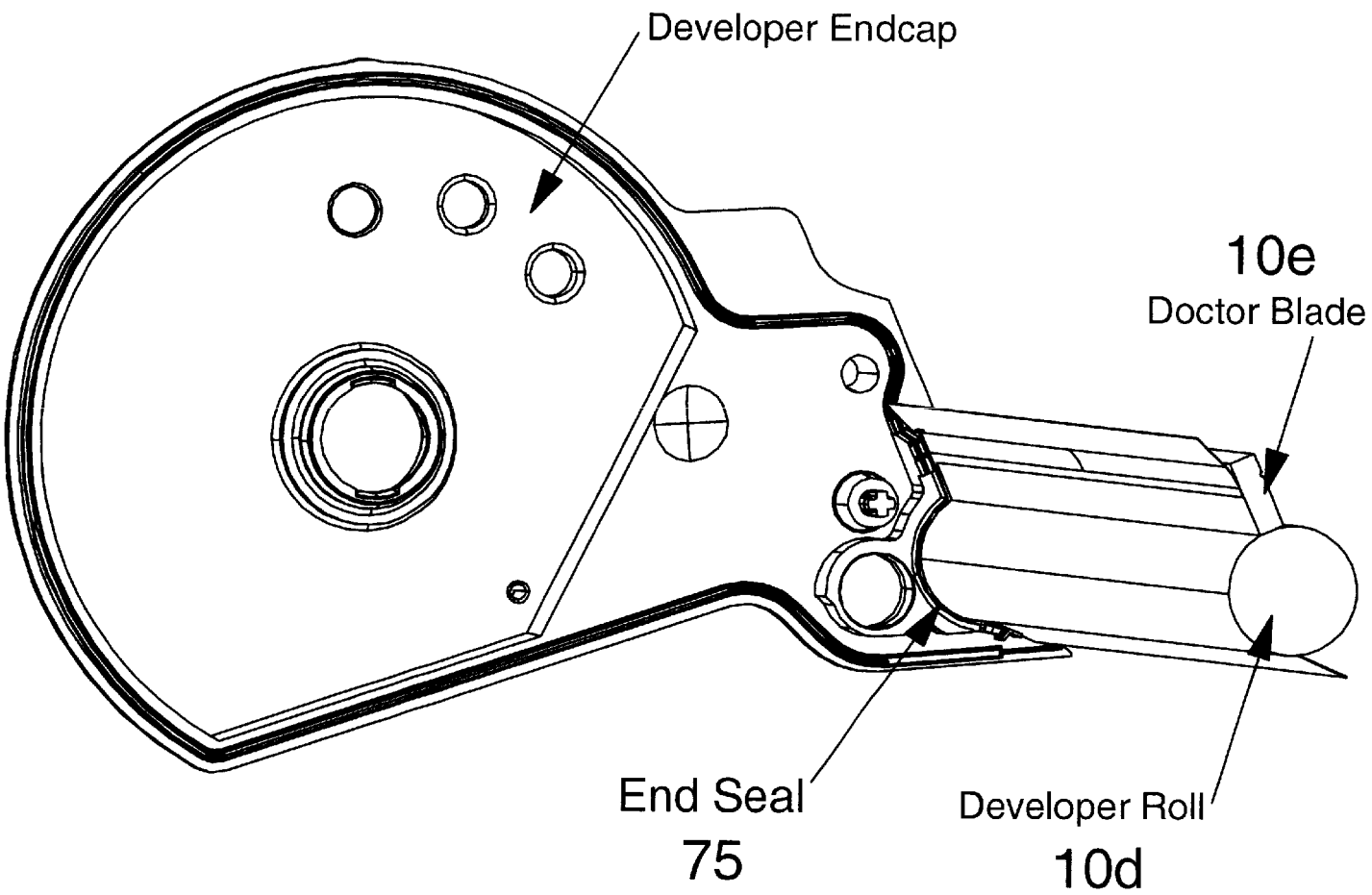
FIG. 7 is a cut-away schematic view showing the placement of the seal of the present invention in the process (toner) cartridge of an electrophotographic process.

The seal can be molded from any flexible, low modulus material known in the art. Examples of such materials include urethane, and artificial rubber having a Shore A hardness of from about 55 to about 74 (such as Santoprene). Preferred seals are made from an artificial rubber material having a Shore A hardness of from about 55 to about 74. A schematic of the end seal of the present invention in use is shown in FIGS. 6 and 7. In this embodiment, the seal acts effectively to prevent leakage of toner from the developer cartridge.

The seal of the present invention provides advantages over the currently-used seals in a number of respects:

(1) Ease of assembly. The seal of the present invention can be simply placed in the developer housing and will self-locate after installation of the developer roll. Prior art designs require press fitting into a side pocket and the positioning requirements are precise.

(2) Elimination of unnecessary parts. The features needed for support of and mating with the seal of the present invention can all be molded integrally into the developer housing. This eliminates the need for attachment of end caps on either end of the developer roll. Eliminating the need for these end caps allows all the critical features in the developer to be molded into a single housing piece, thus allowing tighter tolerances and simpler developer housing manufacture.

(3) Elimination of other sealants, such as wax and putty. Elimination of weld lines and other joints in the front of the developer housing removes the need for using sealants such as wax and putty that are frequently used to seal these joints. The wax and putty are difficult to install, must be installed very precisely to seal properly, and can contaminate other portions of the developer cartridge.

Although the seals of the present invention have been illustrated using the specific embodiments described herein, the present invention is intended to encompass the seals as broadly described herein, including all equivalent structures of those specifically described in the present application.

What is claimed is:

1. A sealing member for an image forming apparatus including a frame member, a developer roll and a blade member, structured so as to prevent leakage of toner in the image forming apparatus, said sealing member being made from a flexible, low modulus material and comprising:

a rotary seal portion for sealing a space formed between the frame member and the developer roll, said rotary seal portion incorporating ridges set at an angle across its face adjacent to the surface of said developer rolls, said ridges being from about 0.05 to about 0.5 millimeters in height and running at an angle to the developer roll process direction so as to push toner away from the edge of said developer roll as said developer roll rotates;

a blade seal portion for sealing a space formed between the frame member and the blade member; and a means for biasing said sealing member toward the surface of said rotary member and said blade member.

2. The sealing member according to claim 1 wherein the means for biasing is selected from cantilever beams, cantilever springs, foam springs, and combinations thereof.

3. The sealing member according to claim 2 wherein the means for biasing are cantilever springs.

4. The sealing member according to claim 1 made from a material having a Shore A hardness of from about 55 to about 74 selected from the group consisting of urethane, artificial rubber, and combinations thereof.

5. The sealing member according to claim 4 made from artificial rubber.

6. The sealing member according to claim 1 wherein a width of the ridges at their base is from about 0.01 to about 0.5 millimeters.

7. The sealing member according to claim 6 wherein the ridges form an approximate right angle to the rotating surface at their peak.

8. The sealing member according to claim 7 wherein the height of the ridges is about 0.1 millimeter, the width of the ridges at their base is about 0.2 millimeters, the means for biasing are cantilever springs, and the seal is made from an artificial rubber having a Shore A hardness of from about 55 to about 74.

9. The sealing member according to claim 1 wherein the blade end portion is structured so as to be held in place between the blade member and frame member in use.

10. A process cartridge detachably mountable to an image forming apparatus, said process cartridge comprising:

a frame member;

a developer roll mounted on said frame member; said developer roll constituting process means;

a blade member elastically contracting said rotary member; and a sealing member to prevent leakage of toner from the cartridge, said sealing member being made from a flexible, low modulus material, said sealing member comprising:

a rotary seal portion for sealing a space formed between the frame member and the developer roll, said rotary seal portion incorporating ridges set at an angle across its face adjacent to the surface of said developer roll, said ridges being from about 0.05 to about 0.5 millimeters in height and running at an angle to the developer roll process direction so as to push toner away from the edge of said developer roll in use;

a blade seal portion for sealing a space formed between the frame member and the blade member, and a means for biasing said sealing member toward the surface of said rotary member and said blade member.

11. The process cartridge according to claim 10 wherein the biasing means on the seal is selected from cantilever beams, cantilever springs, foam strips, and combinations thereof.

12. The process cartridge according to claim 11 wherein the seal member is made from a material having a Shore A hardness of from about 55 to about 74 selected from urethane, artificial rubber, and combinations thereof.

13. The process cartridge according to claim 12 wherein the seal member is made from an artificial rubber.

14. The process cartridge according to claim 12 wherein the means for biasing on the seal member are cantilever springs.

15. The process cartridge according to claim 10 wherein a width of the ridges at their base on the sealing member is from about 0.01 to about 0.5 millimeters.

16. The process cartridge according to claim 15 wherein the ridges on the sealing member form an approximate right angle at their peak.

17. The process cartridge according to claim 16 wherein, in the sealing member, the height of the ridges is about 0.1 millimeter, the width of the ridges at their base is about 0.2 millimeters, the means for biasing are cantilever springs, and the sealing member is made from artificial rubber having a Shore A hardness of from about 55 to about 74.

18. The process cartridge according to claim 10 wherein the blade end portion of the sealing member is structured so as to be held in place between the blade member and the frame member in use.

19. A process cartridge detachably mountable to an image forming apparatus, said process cartridge comprising:

a frame member;

a developer roll mounted on said frame member; said developer roll constituting process means;

a blade member elastically contracting said rotary member; and a sealing member to prevent leakage of toner from the cartridge, said sealing member being made from a flexible, low modulus material, said sealing member comprising:

a rotary seal portion for sealing a space formed between the frame member and the developer roll, said rotary seal portion incorporating ridges set at an angle across its face adjacent to the surface of said developer roll, said ridges running at an angle of about 10° to the developer roll process direction so as to push toner away from the edge of said developer roll in use;

a blade seal portion for sealing a space formed between the frame member and the blade member, and a means for biasing said sealing member toward the surface of said rotary member and said blade member.

* * * * *